United States Patent [19]

Artzberger

[11] Patent Number: 4,732,507

[45] Date of Patent: Mar. 22, 1988

[54] WALK BEHIND SOIL COMPACTOR HAVING A DOUBLE VIBRATORY DRUM AND AN ARTICULATED FRAME

[75] Inventor: Thomas G. Artzberger, Menomonee Falls, Wis.

[73] Assignee: M-B-W, Inc., Slinger, Wis.

[21] Appl. No.: 21,163

[22] Filed: Mar. 3, 1987

[51] Int. Cl.[4] ..... E01C 19/28

[52] U.S. Cl. ..... 404/117; 404/127; 404/132

[58] Field of Search ..... 404/103, 117, 122, 132, 404/127

[56] References Cited

U.S. PATENT DOCUMENTS

| | | | |
|---|---|---|---|
| 2,549,182 | 4/1951 | Ekenstam | 404/132 X |
| 3,108,520 | 10/1963 | Garis et al. | 404/132 |
| 3,426,660 | 2/1969 | Scott | 404/117 |
| 3,516,341 | 6/1970 | Olsen | 404/103 |
| 3,543,656 | 12/1970 | Roettger | 404/117 |
| 3,814,531 | 6/1974 | Carnahan et al. | 404/117 |
| 4,610,567 | 9/1986 | Hosking | 404/132 X |

FOREIGN PATENT DOCUMENTS

| | | | |
|---|---|---|---|
| 1090088 | 11/1967 | United Kingdom | 404/122 |

OTHER PUBLICATIONS

J. I. Case, "Rammax, The Versatile Trench Compactor".

M-B-W, Inc. "SD Series".

*Primary Examiner*—James A. Leppink

*Assistant Examiner*—Matthew Smith

*Attorney, Agent, or Firm*—Andrus, Sceales, Starke & Sawall

[57] ABSTRACT

An improved walk behind soil compactor having a double vibratory drum and an articulated frame. The compactor includes a rear drive unit having a pair of drive wheels and a forward frame is connected to the forward end of the rear drive unit by an articulated joint. The forward frame is attached through isolation mounts to a drum frame that includes a vertical support plate. A horizontal shaft is journaled with respect to the plate and a pair of drums are secured to the shaft on either side of the support plate. A power operated drive mechanism carried by the drum frame is connected through a gear drive to the shaft to drive the drums and a vibratory unit mounted on the drum frame imparts vibration to the drums. As the drums are supported solely from the central vertical support plate, the compactor is capable of compacting soil immediately adjacent to vertical walls.

9 Claims, 5 Drawing Figures

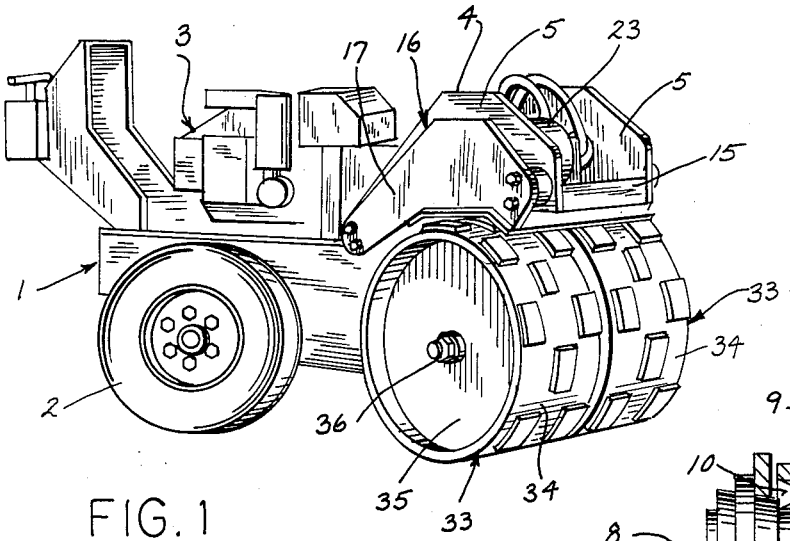
FIG. 1
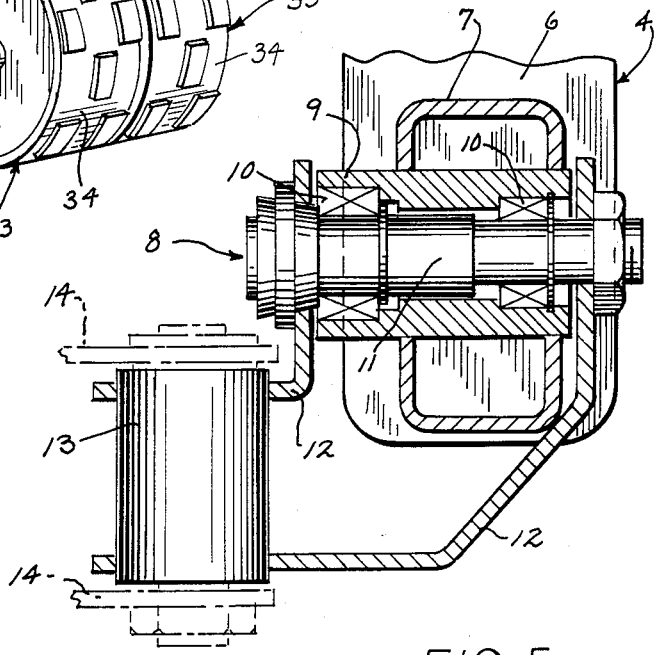
FIG. 5
FIG. 4
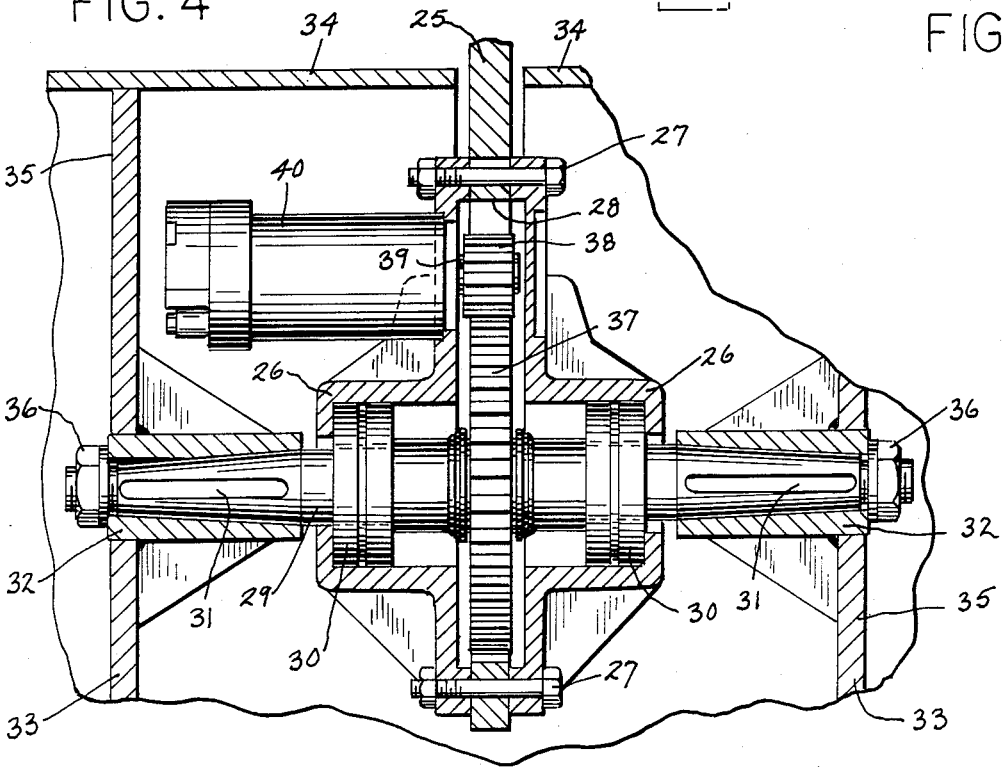

WALK BEHIND SOIL COMPACTOR HAVING A DOUBLE VIBRATORY DRUM AND AN ARTICULATED FRAME

BACKGROUND OF THE INVENTION

One common type of vibratory walk behind soil compactor includes a single vibratory drum which is journaled between a pair of end plates. Walk behind soil compactors are frequently used to compact soil in trenches, and because of the presence of the end plates in a single drum unit, the soil adjacent the walls of the trench cannot be adequately compacted. With deep trenches, soil compactors are frequently operated remotely to eliminate the need of workmen being in the trench. However, with the use of a single drum compactor, manual labor is required to compact the soil adjacent the walls of the trench, thereby requiring workmen to be in a potentially dangerous position in the deep trench.

More recently, double drum soil compactors have been used including a single or central vertical support plate with a drum cantilevered outwardly from each side of the plate. The double drum compactor has the advantage that there is no supporting frame located outwardly of the ends of the drum so the drum can be used to compact soil immediately adjacent the walls of the trench or vertical wall. However, a double drum soil compactor as used in the past has been employed with a rigid non-articulated frame and steering has been accomplished by driving each drum, as well as the rear drive wheels, through independent hydraulic motors. With the use of a rigid frame, the compactor cannot float so that there is a tendency to compact the high spots, but leaving the low spots inadequately compacted.

SUMMARY OF THE INVENTION

The invention is directed to an improved walk-behind soil compactor having a novel double vibratory drum construction and an articulated frame. In accordance with the invention, the soil compactor includes a rear unit having a pair of drive wheels and a forward frame is connected to the forward end of the rear unit through an articulated joint.

Connected to the forward frame through isolated mounts is a drum frame that includes a vertical support plate and a horizontal shaft is journaled for rotation with respect to the plate. A pair of compaction drums are mounted on the shaft on either side of the central support plate and the central plate and shaft constitute the sole support for the drums, there being no external frame or support located outwardly of the ends of the drums.

To drive the drums, a power unit, such as a hydraulic motor, is mounted on the support plate and is connected through a gear drive to the shaft.

In addition, a vibratory or exciter unit is mounted on the upper end of the drum frame and imparts a vibratory motion to the drum frame and drums.

As the drums are cantilevered on the shaft that is carried by the central support plate there are no frame members located outwardly at the ends of the drum, so that the drums can compact the soil immediately adjacent a vertical wall or obstruction. Further, the drums can be readily removed for maintenance, or for substitution of drums of different sizes by merely unthreading retaining nuts threaded on the ends of the shaft.

Since the forward frame is connected to the rear drive unit through an articulated joint, the drums can move with both vertical and horizontal pivotal movement relative to the rear drive unit to enable the compactor to float over the terrain and provide more uniform compaction for high and low areas.

Because the vibratory unit is mounted on the drum frame, which is connected to the forward frame through isolation mounts, transmission of vibration to the forward frame and rear drive unit is minimized.

The wheels of the rear drive unit, as well as the drums are driven, so that better traction is achieved.

Other objects and advantages will appear in the course of the following description.

DESCRIPTION OF THE DRAWINGS

The drawings illustrate the best mode presently contemplated of carrying out the invention.

In the drawings:

FIG. 1 is a perspective view of the soil compactor of the invention;

FIG. 4 is an enlarged fragmentary vertical section showing the drum drive mechanism; and FIG. 5 is an enlarged fragmentary vertical section showing the articulated joint between the rear drive unit and the forward frame.

DESCRIPTION OF THE ILLUSTRATED EMBODIMENT

Figure 2:
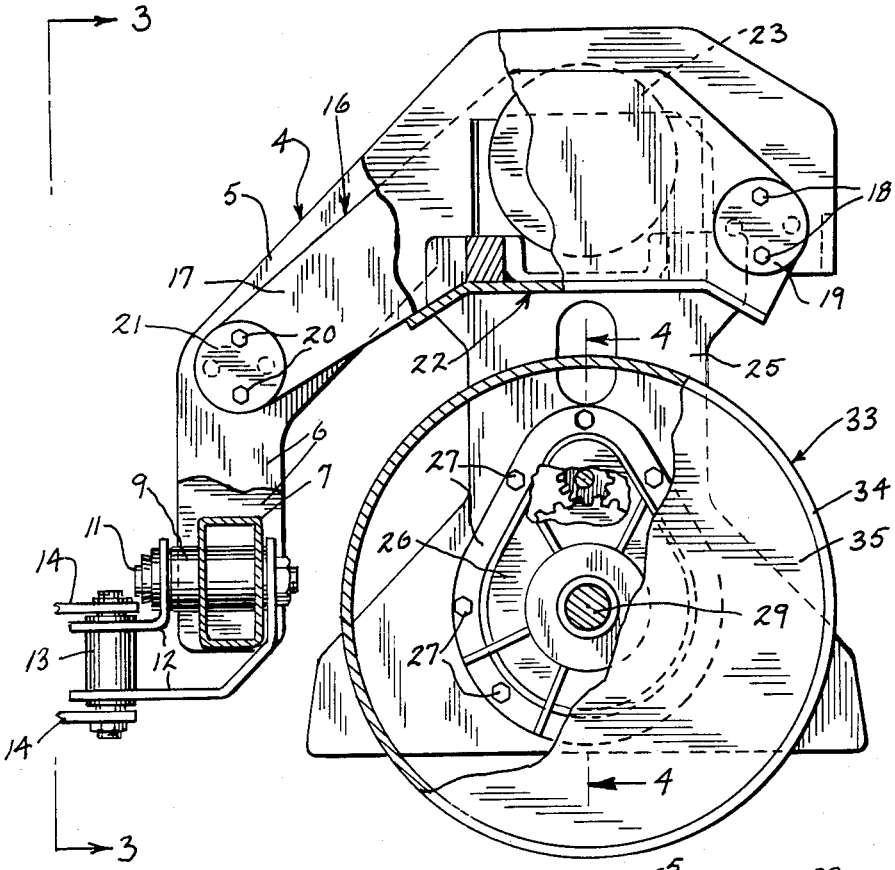
FIG. 2 is a side elevation of the forward end of the compactor with parts broken away.
Figure 3:
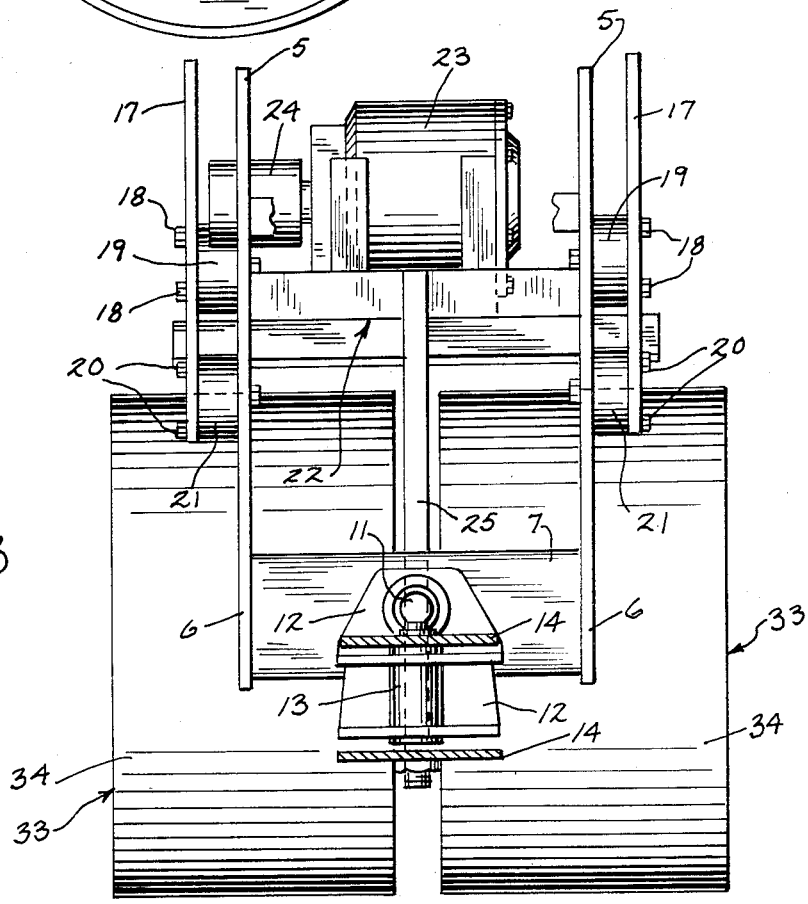
FIG. 3 is a vertical section taken along line 3—3 of FIG. 2.

The drawings illustate a walk behind vibratory soil compactor including a rear drive unit 1 having a pair of wheels 2 that are driven in a conventional manner by an internal combustion engine 3 mounted on the rear drive unit.

A forward frame 4 is connected to rear drive unit 1 includes a pair of spaced vertical plates 5, the rear ends 6 of which extend downwardly and are connected together by a generally rectangular horizontal beam 7, as shown in FIG. 5. Frame 4 is connected to rear unit 1 by an articulated joint 8 that includes a tube 9 mounted within aligned openings in the walls of beam 7 and a pair of bearings 10 are secured in the ends of tube 9. Shaft 11 is journaled within bearings 10 and the ends of shaft 11 are connected to generally L-shaped brackets 12 which are mounted for rotation upon a vertical shaft 13 that is carried by bracket 14 attached to rear drive unit 1. The articulated joint 8 itself is conventional and permits forward frame 4 to pivot about the axis of shaft 11, as well as pivoting about the vertical axis of shaft 13.

The forward ends of plates 5 are connected by a cross plate 15, as shown in FIG. 1.

The compactor also includes a drum frame 16 composed of a pair of parallel spaced vertical plates 17 which are located outwardly of the respective plates 5 of frame 4. The forward ends of plates 17 are connected to the corresponding plates 5 by bolts 18 that extend through resilient isolation mounts 19 located between the plates. Similarly, the rear ends of plates 17 are connected to the corresponding plates 5 by bolts 20 which pass through resilient isolation mounts 21. Isolation mounts 19 and 21 tend to minimize the transmission of vibration from the drum frame 16 to the frame 4 as well as to rear drive unit 1.

A cross frame 22 connects the lower edges of plates 17, extending beneath plates 5 of frame 4, and a vibratory or exciter unit 23 is mounted on cross frame 22. Vibratory unit 23 is a conventional type driven by a hydraulic motor 24 and includes an eccentric weight mechanism which imparts vibrations to the drum frame 16.

Drum frame 16 also includes a central vertical support plate 25 which is secured to the cross frame 22 and extends downwardly. A pair of housing sections 26 are secured by bolts 27 to opposite faces of plate 25 and enclose a central opening 28 in the plate.

As best shown in FIG. 4, a shaft 29 is journaled within housing sections 26 by a pair of bearings 30 which are mounted in the respective housing sections. The ends of shaft 29 project through openings in the respective housing sections 26 and each projecting end of shaft 29 is secured by key 31 to the central hub 32 of a drum 33. Each drum is formed with a generally cylinderical outer shell 34 and an internal wall 35 which connects the outer shell to the hub 32.

As shown in FIG. 2, the outer ends of shaft 29 are threaded and receive washers and nuts 36 which retain the drums 33 on the ends of the shaft.

To drive the drums 33, a gear 37 is keyed to the central portion of shaft 29 and gear 37 is engaged with a pinion 38 mounted on the drive shaft 39 of hydraulic motor 40. Hydraulic motor 40, as shown in FIG. 2, is mounted within an opening in one of the housing sections 26. With this drive arrangement, operation of the hydraulic motor will drive the pinion which in turn will drive gear 37 to rotate the drums 33.

While the drawings illustrate a single motor operating through the gear drive to drive both drums 33, it is contemplated that separate drive units can be utilized for each drum.

If desired, a scraper blade, not shown, can be utilized in conjunction with drums 33. The scraper blade can be connected to the lower edge of central support blade 25 and acts to scrape soil or other material that may have adhered to the surface of the drum.

The drum can either be a smooth surface drum or a sheeps foot drum, as desired.

As the drums 33 are supported solely from the central vertical plate 25, there are no end frame members or supports located at the ends of the drums. Thus the drums can be moved immediately adjacent a vertical wall or abutment.

The articulated joint between the rear unit and the forward frame 4 enables the compactor to float over the terrain and ensures more uniform compaction of both high and low areas.

As the vibratory unit is mounted on the drum frame, it serves to impart vibratory motion to the drums. However, the isolation mounts 19 and 21 that connect the drum frame 16 with the forward frame 4 minimize the transmission of vibrations to the rear drive unit 1.

Various modes of carrying out the invention are contemplated as being within the scope of the following claims particularly pointing out and distinctly claiming the subject matter which is regarded as the invention.

I claim:

1. A soil compactor, comprising a rear unit having a drive wheel means, first frame means, articulated joint means connecting said first frame means to said rear unit, second frame means connected to said first frame means and including a vertical support plate, horizontal shaft means journalled for rotation on said support plate, a pair of drums mounted on said shaft means and positioned on either side of said plate, said shaft means being supported solely by said plate, drive means for driving said drums and including a drive element extending between said drums and operably connected to said shaft means, and vibratory means mounted on said second frame means for imparting vibration to said drums.

2. The compactor of claim 1, and including vibration isolation means interconnecting said first frame means and said second frame means.

3. The compactor of claim 1, wherein said first frame means includes a pair of generally parallel first frame members and said second frame includes a pair of generally parallel second frame members, said support plate being disposed between said second frame members.

4. The compactor of claim 3, wherein said second frame members are disposed laterally outside of said first frame members.

5. A soil compactor, comprising a drive unit having a pair of drive wheels, a first frame, articulated joint means for connecting said first frame to an end of said drive unit, said articulated joint means being constructed and arranged to permit said first frame to pivot in both horizontal and vertical directions relative to said drive unit, a second frame connected to said first frame and including a generally vertical support plate having a central opening, horizontal shaft means extending through said opening and journalled for rotation with respect to said plate, a drum mounted on each end of said shaft means, said drums being disposed on either side of said plate. power operated drive means mounted on said plate and disposed within one of said drums, said drive means being operably connected to said shaft means to rotate said drums, and vibratory means mounted on second frame for imparting vibration to said drums.

6. The compactor of claim 5, and including a pair of housing sections, said housing sections being secured to opposite sides of said plate and enclosing the opening therein, and bearing means associated with said housing sections for journalling said shaft means for rotation.

7. The compactor of claim 5, and including vibration dampening means interconnecting said first frame and said second frame.

8. The compactor of claim 5, wherein said first frame includes a pair of generally parallel first plates and said second frame includes a pair of generally parallel second plates disposed parallel to said first plates, said second frame also including a cross member connecting said second plates together, said vibratory means being supported by said cross member.

9. The compactor of claim 8, wherein said second plates are located laterally outward of said first plates and said cross member extends beneath said first plates, said vibratory means being located between said first plates.

* * * * *